US007360354B2

(12) United States Patent
Grassi

(10) Patent No.: US 7,360,354 B2
(45) Date of Patent: Apr. 22, 2008

(54) METHOD AND DEVICE FOR THE PRODUCTION OF COVERED ELASTIC YARN AND FOR AUTOMATICALLY REPLACING FEEDING SPOOLS

(75) Inventor: Nerino Grassi, Mantova (IT)

(73) Assignee: Giudici S.p.A., Ancona (IT)

( * ) Notice: Subject to any disclaimer, the term of this patent is extended or adjusted under 35 U.S.C. 154(b) by 324 days.

(21) Appl. No.: 10/531,157

(22) PCT Filed: Oct. 16, 2003

(86) PCT No.: PCT/IT03/00633

§ 371 (c)(1),
(2), (4) Date: Apr. 12, 2005

(87) PCT Pub. No.: WO2004/035446

PCT Pub. Date: Apr. 29, 2004

(65) Prior Publication Data

US 2005/0278913 A1 Dec. 22, 2005

(30) Foreign Application Priority Data

Oct. 17, 2002 (EP) ..... 02425632

(51) Int. Cl.
*D02G 3/36* (2006.01)

(52) U.S. Cl. ..... 57/6; 57/266; 57/267

(58) Field of Classification Search ..... 57/3, 57/6, 19, 266, 276, 280
See application file for complete search history.

(56) References Cited

U.S. PATENT DOCUMENTS 3,940,917 A 3/1976 Strachan
4,015,786 A 4/1977 Slavik et al.
4,430,780 A 2/1984 Sear et al.
4,829,757 A 5/1989 Canton
5,008,992 A 4/1991 Gehrmann et al.
5,010,631 A 4/1991 Ritter
5,146,660 A 9/1992 Ritter
5,568,719 A * 10/1996 Proctor ..... 57/225
5,970,593 A 10/1999 Sear
6,370,858 B1 * 4/2002 Mori ..... 57/6
6,393,817 B1 5/2002 Coró

(Continued)

FOREIGN PATENT DOCUMENTS

EP 0 359 453 A2 3/1990
EP 0 564 400 B1 10/1993
EP 0 985 621 A2 3/2000
JP 3279437 12/1991

*Primary Examiner*—Shaun R Hurley
(74) *Attorney, Agent, or Firm*—McGlew & Tuttle, P.C.

(57) ABSTRACT

The device comprises in combination: an interlacing jet for reciprocally joining the covering yarn and the elastic yarn; supporting elements for spools of elastic yarn; winding members for winding the composite yarn on a developing cop; a device for interrupting the feeding of composite yarn to the developing cop and starting the winding of the composite yarn on a new winding tube. The supporting elements for the spools of elastic yarn are suitable for arranging at least one first spool of elastic yarn in a working position and at least a second spool of elastic yarn in a standby position and for transferring the second spool from the standby position to the working position. Furthermore, a retaining member is arranged near the interlacing jet to withhold an initial free end of the elastic yarn of the second spool in standby position. Elements are also provided for introducing the elastic yarn of the second spool in the interlacing jet.

38 Claims, 8 Drawing Sheets

U.S. PATENT DOCUMENTS 6,848,151 B2 * 2/2005 Bakker et al. ..... 28/271
6,880,212 B2 * 4/2005 Bakker et al. ..... 28/271
6,880,319 B2 * 4/2005 Zhu ..... 57/3
2006/0042220 A1 * 3/2006 Maccabruni et al. ..... 57/264

* cited by examiner

METHOD AND DEVICE FOR THE PRODUCTION OF COVERED ELASTIC YARN AND FOR AUTOMATICALLY REPLACING FEEDING SPOOLS

TECHNICAL FIELD

The invention relates to a method and a device for the production of composite yarn of the type comprising a core, consisting of at least one elastic yarn, and an external coating, consisting of at least a covering or coating yarn, which is essentially not elastic or which is less elastic than the core.

More specifically, the invention relates to a method and a device for automatically replacing spools of elastic yarn which are finished or nearly finished.

BACKGROUND ART

Composite elastic yarns, including an inner elastic yarn, such as e.g. a single filament yarn, of so-called Lycra®, elastan or other polyurethane fibers or the other, are frequently used in the production of fabrics and particularly knitwear, such as, for example, hosiery. The elastic yarn is covered by a less elastic yarn, which may be considered essentially not elastic, such as, for example nylon®, or other polyamide, polyester or equivalent, typically with a multiple filament structure, i.e. a yarn made of a plurality of strands. This yarn will hereof be called "covering yarn" because it is used to form a sort of coating or covering of the elastic yarn.

The covering of the elastic yarn may be obtained by means of a spiraling process in which the elastic yarn is covered with a helical winding of covering yarn. This process is extremely costly and slow.

A new process of covering or coating elastic yarn has been recently affirmed. This process—known as "interlacing" or "air covering"—consists in using a pneumatic device, commonly called an interlacing jet with a conduit crossed by two yarns (the covering yarn and the elastic yarn). A pressurized air nozzle lets a jet of compressed air into the conduit. The turbulence generating inside the conduit interlaces the covering yarn around the elastic yarn. Devices and methods based on this technology are described in U.S. Pat. No. 6,393,817, U.S. Pat. No. 5,008,992, U.S. Pat. No. 4,829,757, U.S. Pat. No. 3,940,917.

This technology employs pneumatic systems originally developed for machining multiple filament threads to increase bulk and entangle the individual filaments forming the yarn. Examples of interlacing jets developed for this application and used to interlace elastic or elastomeric yarns with covering or coating yarns are described in U.S. Pat. No. 5,970,593, U.S. Pat. No. 5,146,660, U.S. Pat. No. 5,010,631, U.S. Pat. No. 4,430,780, EP-B-564400, JP-A-3,279,437.

The spools of elastic or elastomeric yarn used in systems for the production of covered elastic yarn contain much less yarn than that of the spools or cops of covering yarn. Typically, the elastic yarn on one spool is sufficient for producing a single cop of composite yarn while the covering yarn on one cop is sufficient to make several cops of composite yarn. This means that the spools of elastic yarn must be changed frequently between two subsequent covering or coating yarn cop changes. Replacement is manual. In a system generally equipped with a plurality of heads, each producing a cop of composite yarn, sensors are provided to stop head operation when the respective elastic yarn spool is finished. The operator must intervene to manually replace the ended spool of elastic yarn, and introduces the free end of the new elastic yarn in the interlacing jet to start the winding cycle of a new composite yarn cop. In the case of manual systems, the operator must also replace the completed cop with a new tube on which the new composite yarn is wound. Covering yarn output is stopped during this time.

This operative mode has considerable problems. Firstly, the downtime is long because a single operator must monitor a high number of working heads and a considerable time may elapse from the end of the spool of elastic yarn and the intervention of the operator so that the head can resume the winding cycle. Furthermore, specifically to avoid excessive machine downtime, the spools of composite yarn may be replaced before they are completely finished. The residual yarn cannot be used. This means that a not negligible quantity of elastic yarn is wasted, which is a considerable problem considering the high cost per length of this material.

On the other hand, it is not possible for the operator to arrange a spare spool of composite yarn and join the head or initial free end of the yarn on the spare spool to the tail of the yarn on the spool being processed, which would mean that the spool change would be prepared well before it ends and the entire spool would be used up. This operation is impossible because in known machines the spools of elastic yarn are not unwound by keeping them stationary, but are turned on their axis to unwind the yarn. Consequently, it is impossible for the operator to grasp the end or tail of the spool being processed and join it to the beginning of the yarn on the spare spool. This problem does not occur with the replacement of covering yarn cops because the cops are unwound without turning them on their axes. Consequently, the head-tail of the yarns wound on cops intended to be unwound in sequence can be joined to ensure continuous covering yarn feeding. Furthermore, the cops of covering yarn contain a large amount of yarn and the joining operations can be carried out after a considerable amount of time.

Covering yarn texturing devices may be arranged between the yarn feeding cop and the interlacing jet (see U.S. Pat. No. 6,393,817 and U.S. Pat. No. 5,008,992 in particular). The texturing devices comprise an oven crossed by covering yarn. This means that the yarn must be fed continuously. Indeed, stopping also only temporarily the yarn in the oven would cause destruction or unacceptable damage thereof. The covering yarn must be cut upstream of the texturing section, i.e. upstream of the oven, when the head is stopped, also only for a short time, for the operator to replace the completed elastic yarn spool. The operator re-threads the covering yarn along the entire path from the cop to the interlacing jet when the composite yarn forming head can start again after completing the operations needed to replace the spool and insert the free end of the elastic yarn in the interlacing jet. This entails a long downtime and loss of production. The problem can only be avoided if the operator is capable of intervening promptly to replace the spool of elastic yarn before the machine automatically cuts the covering yarn. Since a single operator is in charge of monitoring a high number of heads which cannot be synchronized, performing this operation in a sufficiently timely way on all heads in the system is never possible. Employment of a higher number of operators on the other hand would cause an unacceptable increase in the cost of labor.

DISCLOSURE OF INVENTION

Object of the present invention is a method for automatically replacing spools of elastic yarn in devices for the production of covered elastic yarn, i.e. composite yarn comprising an elastic core and a covering formed by one or more covering yarns.

According to a different aspect, object of the present invention is a device for the continuous production of cops of composite yarn with automatic replacement of the elastomer spools without needing to interrupt the covering yarn.

These and other objects and advantages, which will be clear to experts of the field in the text that follows, are obtained in practice by a method comprising the following phases:

a. arranging a first spool of a first elastic yarn in a working position and feeding said first yarn to an interlacing jet where it is covered with said covering yarn to produce said composite yarn which is wound on a developing cop;
b. arranging a second spool of a second elastic yarn in a standby position;
c. when the first spool of composite yarn must be replaced with the second spool of composite yarn, interrupting composite yarn feeding to said developing cop, replacing the developing cop with a new tube;
d. inserting said second elastic yarn in said interlacing jet to resume therewith the formation of said composite yarn, said second spool of elastic yarn starting to feed elastic yarn to said interlacing jet and being carried to said working position, if needed, and said second elastic yarn being joined to said covering yarn which moves continuously;
e. starting winding composite yarn on said new tube;
f. if needed, collecting at least the covering yarn fed via said interlacing jet between the winding interruption of the developing cop and the start of winding of the composite yarn on said new tube.

Feeding of the yarn is preferably obtained by keeping the spool in rotation by suitable means, such as a rotating roller.

It should be understood that said phases can be carried out in the specified order or in a different sequence. The composite yarn can be aspirated between the end of the winding of a complete cop and the start of the winding a new cop of composite yarn, if the elastic yarn has not yet finished, or only the covering yarn if the elastic yarn is finished up. Generally, the elastic yarn may end either before or after interrupting winding of the completed cop, since the last turns form a reserve which is intended to be eliminated and which for this reason may be formed by incomplete yarn, i.e. covering yarn only.

The phases above may also not be performed each time a complete cop is replaced with a new tube because the elastic yarn of a single cop may suffice for two (or more) cops of interlaced or composite yarn. In this case, the cycle (consisting of cutting the yarn, replacing the complete cop with a new tube and starting winding on the new tube) is started by means of a sensor for detecting the amount of yarn wound on the final cop by detecting the weight and/or the length of the material.

With the method according to the invention, the leading end of the yarn on the standby cop is arranged by the operator in any instant and withheld for example by a retainer member which releases it to start a new composite yarn cop production cycle when the spool in working position is finished. The spool replacement procedure is automatic, with the exception of spool positioning in standby position and arrangement of the leading end in the retaining member; these operations may easily be carried out by a single operator also on a high number of working heads, considering the long time available before a spool of elastic yarn is finished up. The position of the two spools of elastic yarn may be reversed upon end of the first elastic yarn and beginning of the feeding of the second elastic yarn. However, two fixed positions might also be foreseen for the two spools of elastic yarn.

In principle, the second elastic yarn can be joined to the covering yarn which is fed continuously without interruptions also upstream of the interlacing jet with an interweaving or joining system, e.g. with an auxiliary interlacing jet or other pneumatic system which is operated only during the spool changing phase and is arranged upstream of the interlacing jet which forms the composite or interlaced yarn.

Preferably, however, the second elastic yarn is joined to the covering yarn in the same interlacing jet where the elastic yarn is covered with the covering yarn. For this purpose, the free leading end of the second elastic yarn is withheld downstream to the interlacing jet, so that with a simple traversal movement said second yarn can be inserted in the jet and arranged alongside the covering yarn. The very action of the interlacing jet joins the two yarns and the second elastic yarn starts to be dragged along the path to the winding area of the cop by the covering yarn which is intact and which continues to be fed to the winding area without interruption.

The covering yarn can be a multiple filament yarn, and specifically a textured multiple filament yarn, in a way known per se. Texturing can be carried out preferably in line, i.e. upstream of the interlacing jet, along a feeding path between the covering yarn cop and the interlacing jet. With an arrangement of this kind the invention offers the considerable advantage of avoiding the need to re-introduce the covering yarn through the texturing path following cutting of the yarn when the spools of elastic yarn are finished up.

In principle, the replacement cycle of the first spool of elastic yarn with the second spool of elastic yarn and the replacement of the formed composite yarn cop with a new winding tube can be started either by defining the amount of wound yarn or the amount of elastic yarn unwound from the spool. This however may cause the incomplete unwinding of spools of elastic yarn. Preferably, therefore, the end of the first elastic yarn of the first spool is detected and the beginning of the automatic replacement cycle occurs following a signal generated by said detection. Any system for detecting the end of the yarn may be employed.

The covering yarn is fed continuously also during the elastic yarn spool replacement phase and when the finished cop is replaced with a new winding tube. The covering yarn which is fed during the exchange phase can be collected pneumatically via a suction mouth or in other way, e.g. by winding. This yarn is rejected but the cost is limited because the cost per unit length of the covering yarn is considerably low.

Additional advantageous characteristics and embodiments of the method according to the invention are recited in the annexed dependent claims.

The invention also concerns a device for the production of composite yarn consisting of at least one elastic yarn covered with at least one covering yarn, of the type comprising in combination:

an interlacing jet for reciprocally joining the covering yarn and the elastic yarn;
a feeding path of said covering yarn and a feeding path of said elastic yarn to said interlacing jet;
supporting means for spools of elastic yarn;
winding members for winding the composite yarn on a developing cop;

a device for interrupting the feeding of the composite yarn to said developing cop and starting the winding of the composite yarn on a new winding tube.

According to the invention the device is characterized in that: said supporting means for the spools of elastic yarn are suitable for arranging at least a first spool of elastic yarn in a working position and at least a second spool of elastic yarn in a standby position and for transferring said second spool from the standby position to the working position and vice versa if so required; a retaining member is arranged near said interlacing jet to withhold an initial free end of the elastic yarn of said second spool in standby position; means for introducing the elastic yarn of said second spool in said interlacing jet are provided; and, preferably, said interrupting device is associated to a covering yarn collection member which is fed essentially continuously while the complete cop of composite yarn is replaced with a new winding tube.

The means for supporting the spool of elastic yarn may provide for rotation of the spool around its own axis, if so required. Alternatively, the spool may be unwound by drawing the yarn with the spool kept in a non-rotating position. If the spool is rotating during pay-off of the yarn, a rotating means is provided in the working position of said spool.

Advantageously, at least one texturing station is arranged along the feeding path of the covering yarn.

According to an advantageous embodiment of the device, in order to join the covering yarn (which is continuously fed) by means of the interlacing jet to the leading end of the yarn coming from the second spool, it is foreseen that the retaining member of the free leading end of the elastic yarn of said second spool is combined with a means for inserting said yarn in the interlacing jet, and is arranged downstream of said jet with respect to the direction of advancement of the yarn.

The means for inserting the yarn in the interlacing jet may be formed by the mobility of the retaining member. In other words, the retaining member can be provided with a movement for inserting the elastic yarn in the interlacing jet. Alternatively, the means for inserting the yarn in the jet may comprise a separate introducing member which cooperates with the retaining member, which can in this case also be fixed. If the covering yarn and the elastic yarn are joined upstream of the interlacing jet, the introducing means of the elastic yarn in the interlacing jet is represented by the covering yarn and by its movement along the feeding path.

Additional advantageous characteristics and embodiments of the device according to the invention are recited in the annexed dependent claims.

BRIEF DESCRIPTION OF THE DRAWINGS

The invention will be better understood by following the description and the annexed drawing, which shows a practical and non restrictive embodiment of the invention. More specifically in the drawing, where identical parts are indicated by the same reference numerals.

MODES FOR CARRYING OUT THE INVENTION

Figure 1:
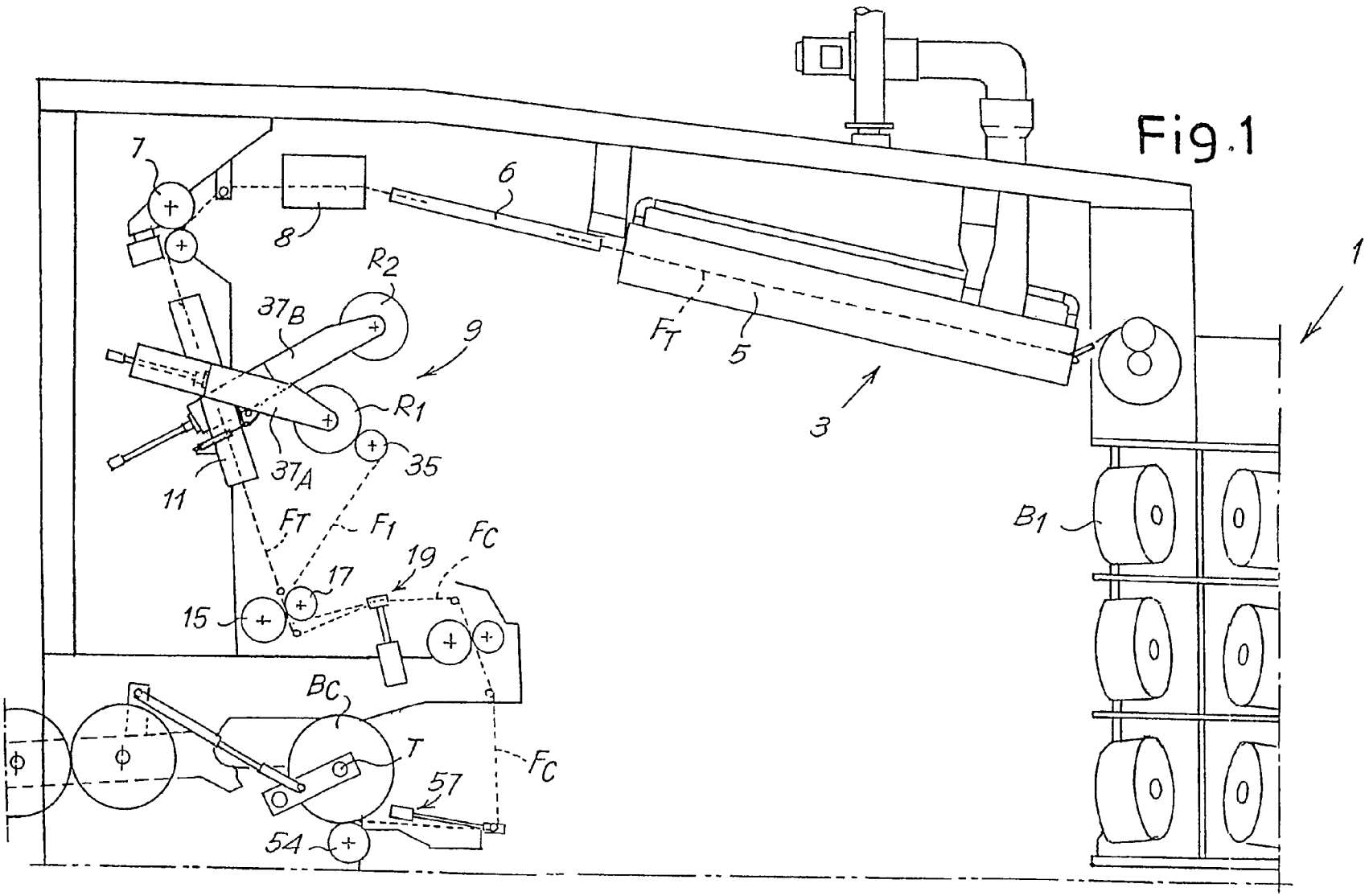
FIG. 1 is a lateral view of a portion of the system for producing composite yarn showing a winding head with the respective covering yarn texturing section.

FIG. 1 shows a lateral view of a system comprising a plurality of winding heads for the production of cops of composite yarn with a set of devices according to the invention. Reference numeral 1 generically indicates the area where the cops B1 of covering yarn, e.g. polyester, nylon or other equivalent yarn, typically a multiple filament yarn, are arranged. The yarn unwound from a cop B1 is fed through a texturing section of the traditional type, known per se, and indicated by reference numeral 3. The texturing area has a heating oven 5, a cooling area 6, a false-twisting section 8, and ends with a pair of rollers 7 for taking the textured covering yarn FT; the covering yarn is fed to an area 9 where the spools of elastic yarn, the interlacing jet, the winding head itself and all the members needed to change the spools of elastic yarn are arranged. This area is shown in greater detail in FIG. 2.

Figure 4A:
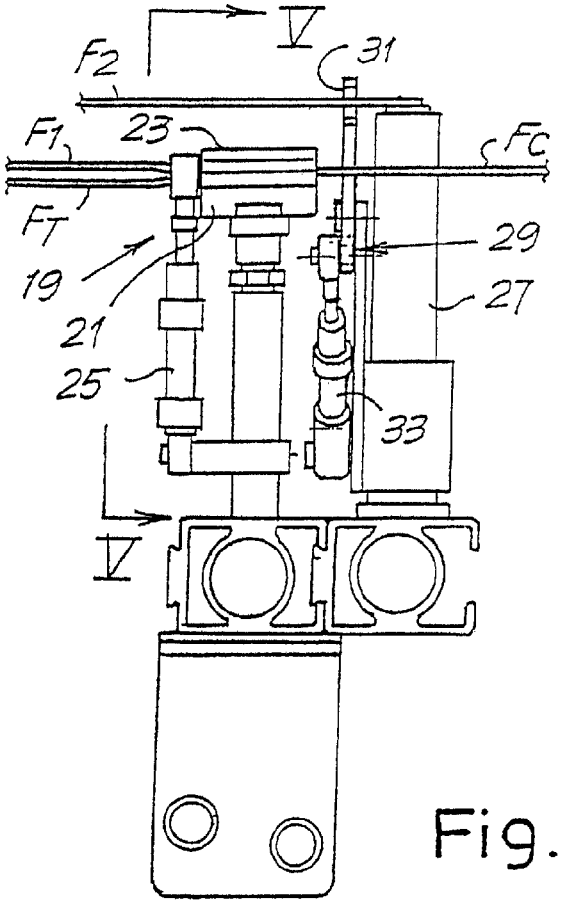
FIGS. 4A and 4B are a magnified views of the interlacing jet, the retaining member of the initial free end of the elastic yarn of the standby spool and the introducing means of said elastic yarn in the interlacing jet in two different positions.
Figure 5A:
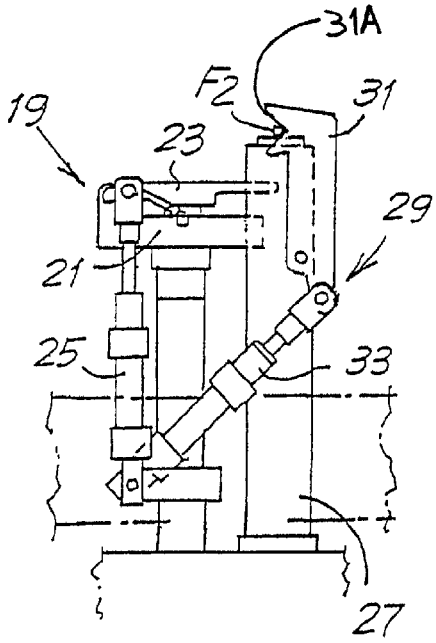
FIGS. 5A and 5B are views according to V-V in FIG. 4A, 4B in two different positions.
Figure 5B:
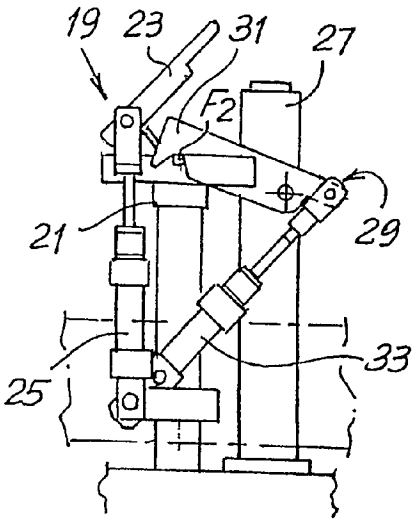
Figure 4B:
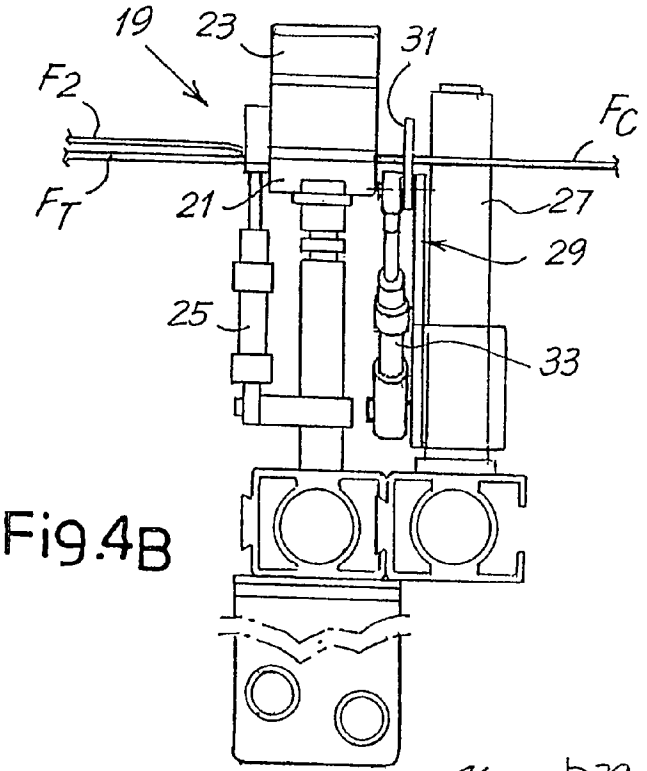

The yarn FT in area 9 may cross an oven 11 (for stabilization purposes) and along its feeding path Pft reaches a stretching area 13, where a stretching unit is arranged, which is formed by a pair of rollers 15, 17, the first of which is driven and the second is idle. An interlacing jet, generically indicated by reference numeral 19 and which may be of a type known per se and which is shown in greater detail in FIGS. 4A, 4B and 5A, 5B, is arranged downstream of the stretching unit 15, 17. It comprises a through conduit, in which the yarn FT slides, provided in a body 21 equipped with a closing covering 23. The cover can be lifted and lowered by means of an oscillating movement controlled by an actuator 25 to open and close an insertion slit for introducing the yarn in the channel of the interlacing jet 19. The closing position of the cover 23 is shown in FIGS. 4A and 5A, while FIGS. 4B and 5B show the jet 19 with the cover 23 open.

As shown again in detail in FIGS. 4A, 4B and 5A, 5B, next to the interlacing jet a retaining member 27 is arranged comprising a suction mouth which is used to engage and withhold the initial free end of the elastic yarn wound on the second spool of elastic yarn which is in standby position, as will be described below. A mechanical gripping member may be arranged inside the suction mouth (not shown), e.g. elastic tongs or the like, which fastens the free end of the yarn once it has been sucked into the mouth of the retaining member 27. The suction mouth 27 is arranged with respect to the direction of feeding of the yarn crossing the interlacing jet downstream of the interlacing jet. An introducing means 29, used to introduce the initial portion of the elastic yarn of the standby spool into the interlacing jet 19 in the way described below, is arranged between the mouth 27 and the interlacing jet 19. The introducing means 29 presents a pivoting arm 31 with a V-shaped end 31A for engaging the elastic yarn. The pivoting movement of the introducing means is controlled by a cylinder-piston actuator 33; the two end positions of the introducing means are shown in FIGS. 4A, 5A and 4B, 5B, respectively.

A first elastic yarn F1, unwound from a first spool R1 of elastic yarn is fed through the nip defined by the stretching rollers 15, 17 forming the stretching unit 13. The spool R1 is unwound from a driven unwinding roller 35 with which it is in contact. The speed of the unwinding roller 35 and of the rollers 15, 17 is adjustable to apply the required degree of stretching to the yarn F1. Additionally, the speed of the rollers 15, 17 can be adjusted with respect to the speed of the pair of rollers 7, so to apply a degree of stretching to the yarn FT which is either equal to or different than the stretching applied to the yarn F1, or relieve the yarn FT.

The spool R1 is supported by an arm 37A pivoting on an axis 39 which is orthogonal to the plane of the figure. In addition to the pivoting movement, controlled by a cylinder-piston actuator 41A, the arm 37A is provided with a translating movement in a direction which is parallel to the longitudinal development of the arm, controlled by an additional cylinder-piston actuator 43A. An additional arm 37B, which is essentially the same as the arm 37A, is pivoted on the same axis 39, and its pivoting movement about axis 39 is controlled by an additional cylinder-piston actuator 41B, similar to the actuator 41A; its translation movement parallel to the longitudinal development thereof is controlled by an actuator 43B, similar to the actuator 43A.

Figure 2:
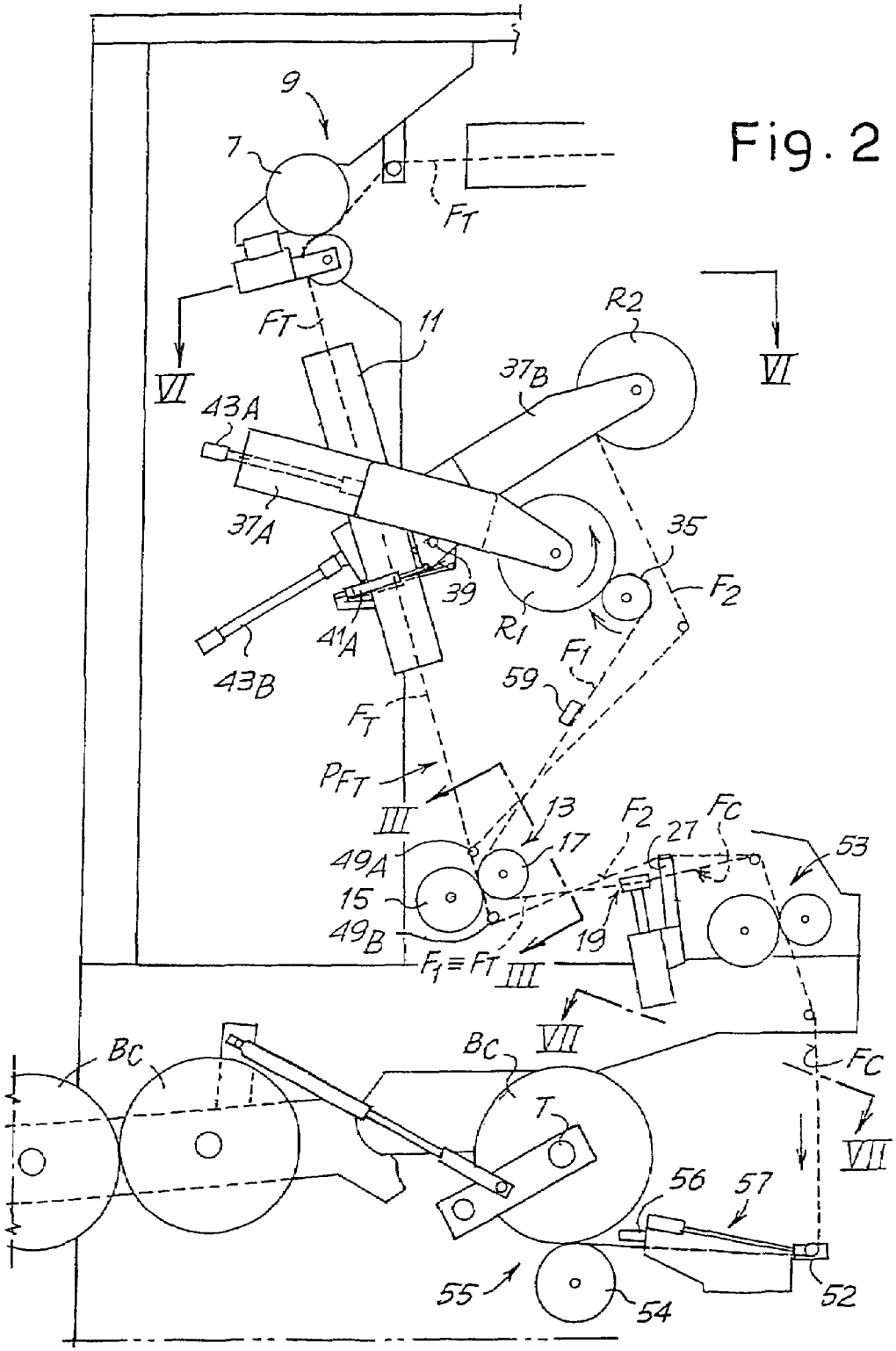
FIG. 2 is a magnified lateral view of the interlacing area with the system for replacing the spools of elastic yarn and the composite yarn cop winding area.
Figure 6:
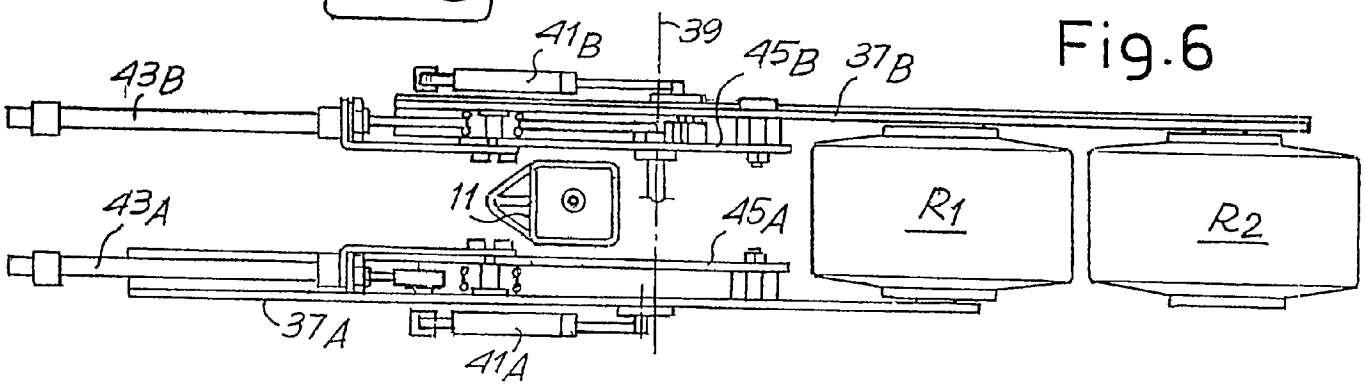
FIG. 6 shows a view according to VI-VI in FIG. 2 of two arms for supporting the spools of elastic yarn.

FIG. 6 shows a plan view of two arms 37A, 37B which, for the sake of simplicity and clarity of drawing, are shown in the parallel and specular position, i.e. in an angular position which is different from that shown in FIG. 2. FIG. 6 shows a plate 45A, 45B, for each of the arms 37A, 37B respectively, which pivots on axis 39 and supports the actuator 43A, 43B and translation guiding means of the arm 37A, 37B.

The pivoting arm 37B supports a second spool R2 on which a second elastic yarn F2 is wound. The spool R2 is shown in the standby position (in FIG. 2) to replace the spool R1 when the latter is finished. The yarn F2 is arranged along a standby path which leads downwards from the spool R2 to the side of the stretching area 13. The head or initial free end of the second elastic yarn F2 is withheld by the retaining member 27. As appears in FIG. 3, the second yarn F2 is withheld in the stretching area 13 in two points by an inserting element 49A, 49B, so to form a straight section arranged on the side of the nip between the rollers 15, 17, which is to be inserted into said nip with a movement of the inserting element 49A, 49B controlled by the actuators 51A, 51B in the instant in which the spool R1 shall be replaced by the spool R2. Downstream of the stretching unit 15, 17, the two yarns F1 and FT follow a common path to the interlacing jet 19, inside which the elastic yarn F1 is covered with the yarn FT to form a composite or interlaced yarn FC in a way known per se. The composite yarn FC reaches a feeding unit 53 comprising a driven roller and an idle roller downstream of the interlacing jet 19. The yarn FC is deviated and guided by a fork 52 downstream of the feeding unit and reaches a winding area, indicated by reference numeral 55 as a whole, where it is wound on a winding tube T to form a cop BC of composite yarn. Mechanisms (which are known per se and not described herein) arranged in the winding area 55 progressively and automatically unload the formed cops BC and replace the completed cops BC with new winding tubes T. Reference numeral 57 generically indicates a device which: interrupts the composite yarn FC after winding a cop, BC; withholds by a suction mouth the yarn which continues to be fed during the phase in which the cop BC is replaced with a new winding tube T and the spool of elastic yarn R1 is replaced with the spool R2; and resumes winding of the yarn FC on the new winding tube T.

Figure 7A:
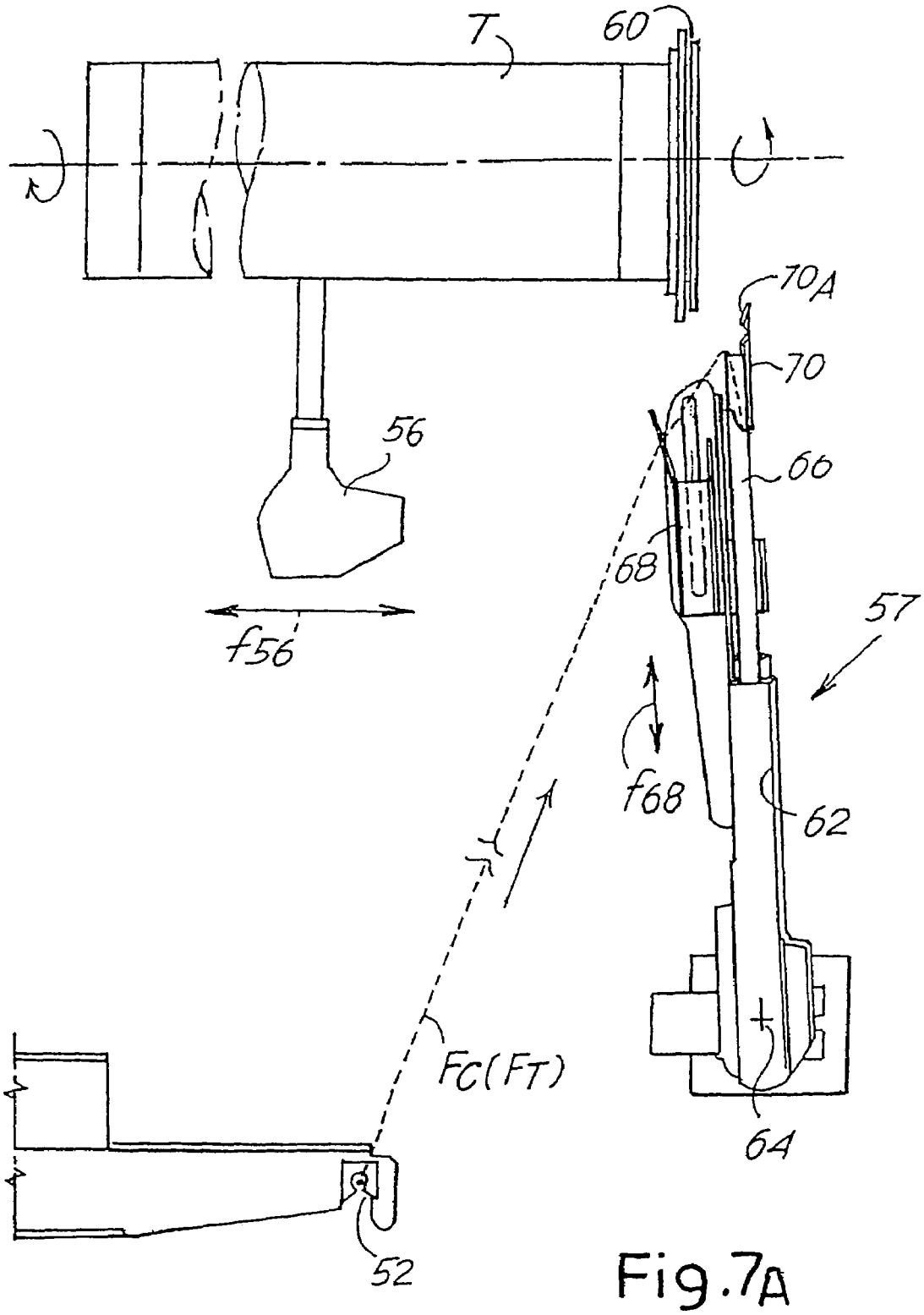
FIGS. 7A, 7B and 7C show the device which interrupts the feed of interlaced yarn to the finished cop and launches the winding of a new cop in three different working positions.
Figure 7B:
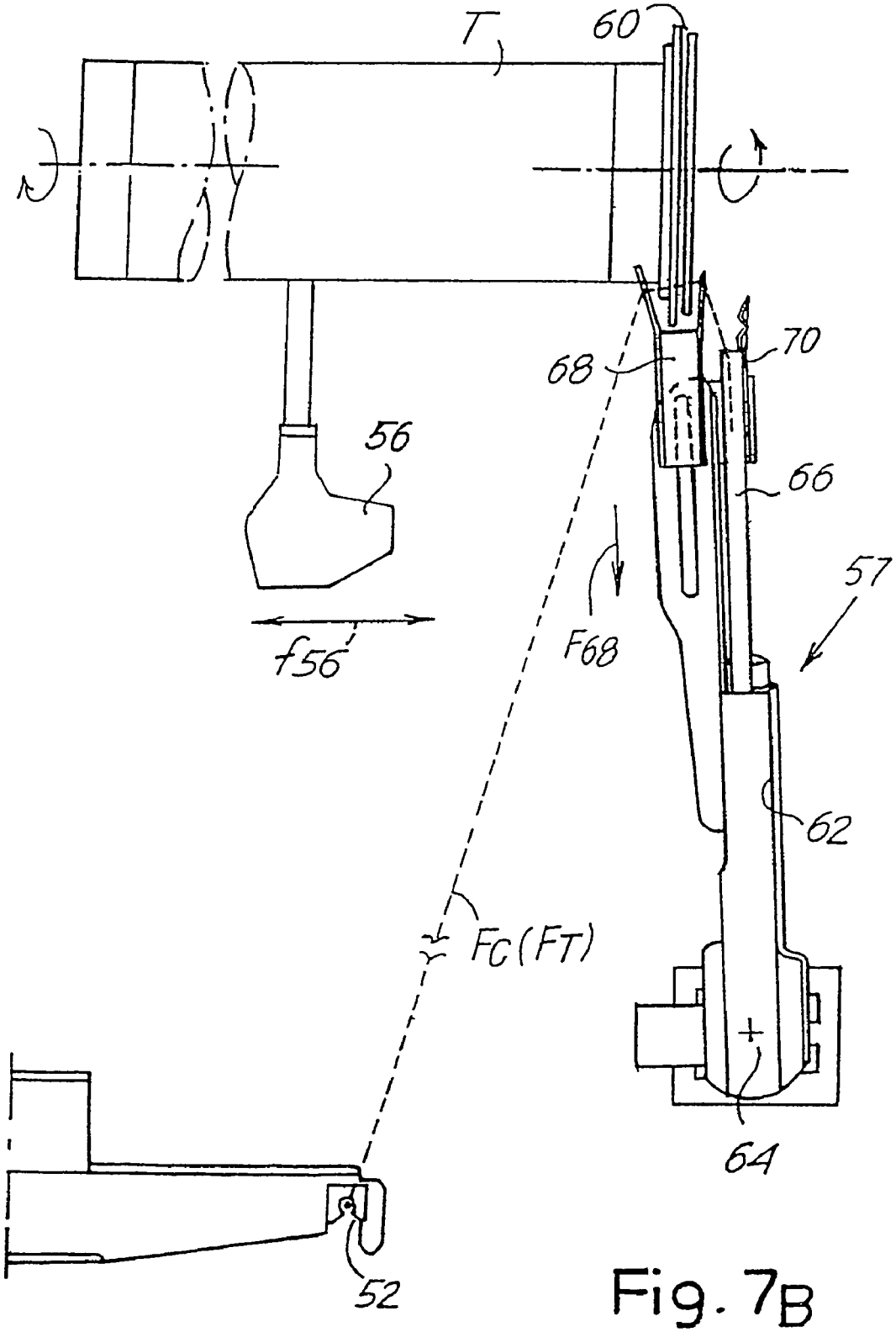
Figure 7C:
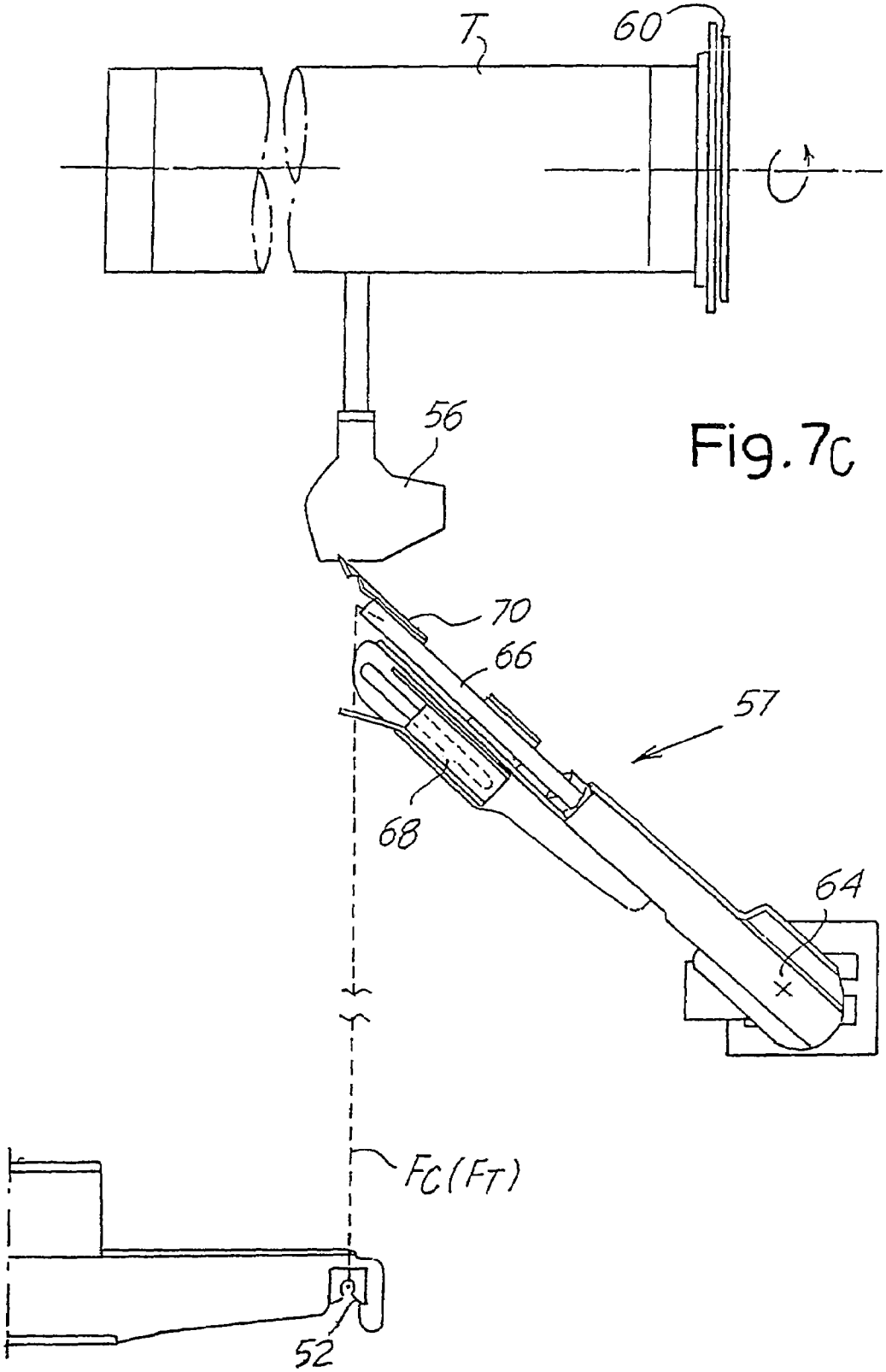

The device 57 is shown in greater detail in the views in FIGS. 7A, 7B and 7C, in three different operating positions, according to VII-VII in FIG. 2. The device 57 in FIG. 7A is shown in standby position before starting to wind a new cop BC of interlaced yarn FC. Reference T indicates the tube which is used for winding and reference numeral 60 indicates a ring, known per se, which is coaxial to the tube T and used to start winding the yarn on the tube. The tube T and the cop BC being developed on the tube are turned by a driven roller 54 underneath (see FIG. 2), so to ensure a constant peripheral speed as the diameter of the developing cop changes. Reference numeral 56 indicates a thread guide or "transverse" which distributes the turns of yarn on the tube T and on the spool BC developing on the tube according to an oscillating or translating movement shown by the double arrow f56.

The device 57 includes an arm 62 pivoting on an axis 64 approximately orthogonal to the plane of FIGS. 7A, 7B, 7C; the arm carries a frontally open suction conduit, indicated by reference numeral 66, a fork 68, which translates according to f68 along the arm and in parallel to the suction conduit 66, and a guiding member 70 which is integral with the conduit 66, to approach the yarn to the mouth of the suction conduit 66.

In the position shown in FIG. 7A, the yarn FC is sucked into the conduit 66. During this phase, the yarn may actually only be the covering yarn FT and not the interlaced yarn FC, because the elastic yarn F1 or F2 (previously fed by the corresponding spool R1 or R2) ends during this phase while the yarn FT is continuously fed also without the elastic yarn F1 or F2. If, however, as mentioned above, the cop BC is replaced with a new winding tube T before the spool R1 or R2 of elastic yarn is finished up (because the spool has an amount of yarn sufficient to produce, for example, two cops of composite yarn FC), the device will suck composite yarn inside the conduit 66 while replacing the cop BC with the tube T until the new winding operation is started.

After inserting the elastic yarn through the interlacing jet 19 and complete interlaced yarn FC is again fed by said jet (after replacing the finished spool R1 of elastic yarn F1 with the spool R2 of elastic yarn F2 in standby position) winding of the interlaced yarn on the new tube T can start, said tube for this purpose being turned on its axis. The yarn FC is approached by the fork 68 to the ring 60, which integrally turns with the tube and grips the yarn to wind it around the tube. The approach phase of the yarn FC to the ring 60 is shown in FIG. 7B. While the yarn forms the first winding turn on the tube T, a blade (not shown) cuts the yarn to separate it from the portion which is inside the suction conduit 66. This generates a free end of the yarn which remains anchored to the tube by effect of winding. By continuing winding of the yarn FC on the tube T, the path of the yarn FC between the guiding fork 52 and the tube T is intercepted by the thread guide 56 which engages the yarn and consequently starts distributing it along the entire axial development of the tube with an alternating movement according to the double arrow f56.

After winding a cop BC on the tube T, the arm 62 is brought to the position shown in FIG. 7C with the guiding member 70 arranged so to intercept the path of the yarn FC reciprocatingly guided by the guide thread 56. The guiding member 70 presents a slanted surface 70A which forces the intercepted yarn FC to be raised to the mouth of the suction conduit 66. At the same time, the yarn FC is cut by a blade (not shown and carried by thread guide 56) in an intermediate position between the finished cop and the guiding member 70. The free end downstream of the cut is wound on the cop BC which is then removed, while the free end upstream to the cut is inserted in the suction conduit 66, which (as described above) starts to suck the yarn; the yarn is continuously fed while the spool of elastic yarn is changed and the complete cop BC is replaced with a new tube. From this position, the arm 62 returns to the position in FIG. 7A waiting for a new winding process to be started as soon as the interlacing jet 19 resumes outputting the complete yarn FC, i.e. after feeding of new elastic yarn F2 is started.

Global operation of the device described hereof is illustrated below. In the configuration shown in FIG. 2, the covering yarn FT (textured upstream of the roller pair 7) is fed to the stretching unit 15, 17 and from here to the interlacing jet 19. In parallel thereto, the elastic yarn F1, fed by the spool R1 which is turned by the unwinding roller 35, is fed to the stretching unit 15, 17 and then to the interlacing jet 19. The composite yarn FC is wound on the cop BC developing on the winding tube T supported by arms 56 in the winding area 55. The second elastic yarn F2 is in standby position with the initial free end engaged by the retaining member 27.

The spool changing phase is started when the end of the first elastic yarn F1 fed by the spool R1 is detected by a sensor 59 arranged between the unwinding roller 35 and the stretching area 13. During this phase, the textured covering yarn FT continues to be fed without stopping, preferably at a substantially constant speed. The sensor 59 can be replaced by another type of sensor, e.g. for detecting the diameter of the finishing spool R1 or the amount of fed yarn F1. A sensor detecting the amount of yarn wound on the cop BC, measured according to weight and/or length, may be combined to the sensor 59 or other equivalent device. Such additional sensor may be used to start the replacement process also before the yarn F1 ends but the cop BC is completed.

The following operations are carried out during the exchange phase. The composite yarn FC is cut between the completed cop BC and the device 57, forming and end or tail which is completely wound on the cop. The other free end formed by the cut is withheld by the device 57 and sucked by the suction mouth 66 as described above with reference to FIG. 7A-7C, and prepared to start new winding. In this way, the end part of the elastic yarn F1 and the covering yarn FT, which continues to be fed continuously, are sucked by the suction mouth and the yarn FT is kept adequately taut along the entire path thereof.

Figure 8:
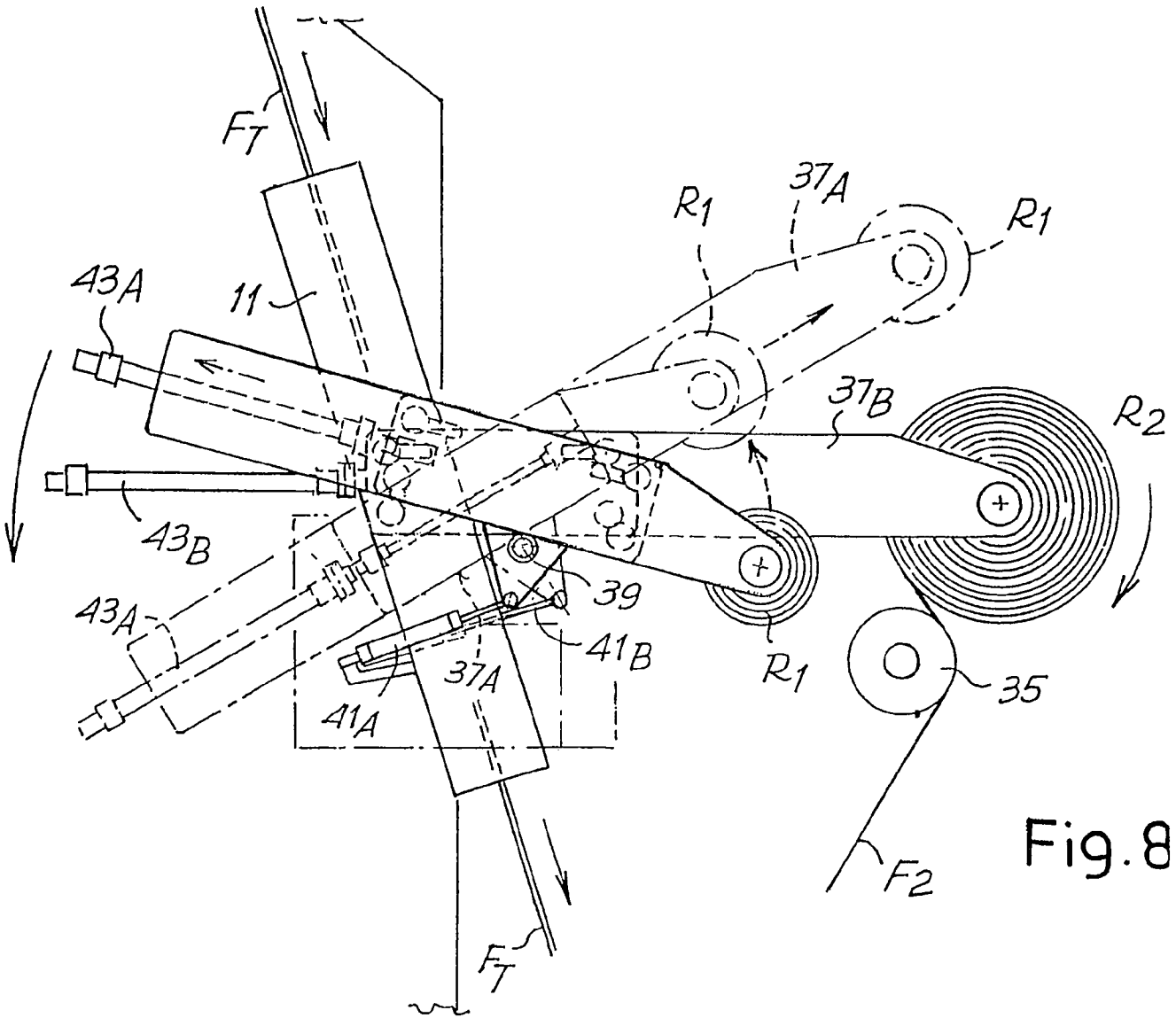
FIG. 8 shows the movement of the system for supporting the spools of elastic yarn.

The arms 37A and 37B (and consequently the finished spool R1 and the standby spool R2 of elastic yarn) are exchanged so that the arm 37A with the finished spool R1 is up and the arm 37B with the spool R2 previously in standby position down; the spool R2 is in contact with the unwinding roller 35. FIG. 8 shows the sequence of movement of the arm 37A. Positions can be exchanged without reciprocally interfering by coordinating the pivoting and translation movements of the two arms 37A, 37B. When arm 37A reaches the final position with the finished spool R1 up, the operator can (at any instant during the unwinding cycle of the spool R2) replace the finished spool R1 with a new spool of elastic yarn which will later be replaced similarly to spool R2 when it finishes in turn.

Figure 3:
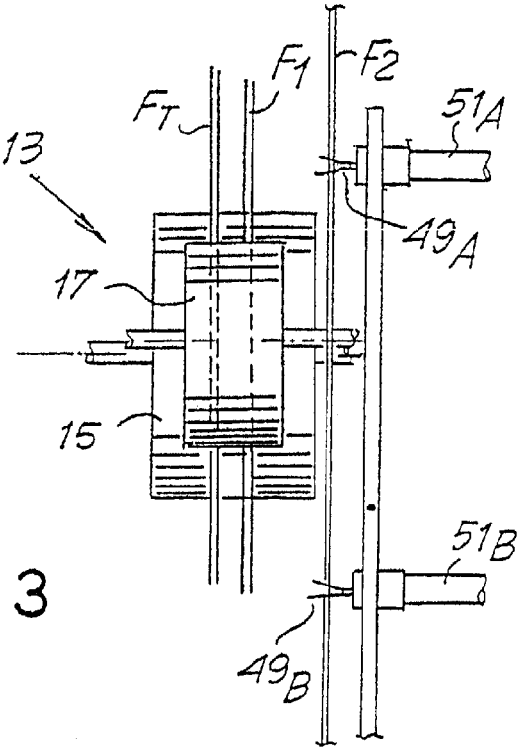
FIG. 3 is a view according to III-III in FIG. 2 of the stretching area with the stretching rollers for the elastic yarn and covering yarn.

When the spool R2 is in condition to feed elastic yarn R2, the elastic yarn is translated from the position shown in FIG. 3 by the introducing element 49A, 49B, 51A, 51B to be introduced in the nip between the stretching rollers 15, 17, next to the yarn FT which continues to be fed through the stretching unit 15, 17. For this purpose, the rollers 15, 17 can be slightly moved apart to facilitate introduction of the elastic yarn F2.

Again during the changing phase, the interlacing jet 19 is opened by raising the closing cover 23 from the position shown in FIG. 4A, 5A to the position shown in FIG. 4B, 5B. The yarn FT continues to be fed continuously through the interlacing jet 19 while the initial part of the second elastic yarn F2 is introduced in the jet via the aperture opened by the cover 23 by the pivoting arm 31 of the introducing element 29, which is lowered, as shown in FIGS. 4A, 4B and 5A, 5B. The cover 23 of the interlacing jet 19 is closed again after introducing the yarn F2 into the latter. The possibility of using an interlacing jet with a longitudinal gap open at all times (as shown, for example, in one of the patents mentioned in the preamble to this description) is not ruled out. In this case, there is no need for the cover 23 and the respective opening and closing actuator.

The yarn F2 may be introduced in the interlacing jet 19 in different ways, for example, by arranging the retaining member 27 in a position vertically above the interlacing jet 19. In this case, the yarn F2 can be introduced into the jet with a vertical movement. A thread guide downstream of the interlacing jet 19 will temporarily lower the trajectory of the yarn emerging from the jet.

The introduction of the initial part of the second elastic yarn F2 in the interlacing jet 19 next to the yarn FT, which continues to be fed to the jet, makes the two yarns join automatically by effect of interlacing caused by the jet. In this case, there is no need for separate joining members, although the two yarns can be joined upstream to the interlacing jet 19. In this case, the yarn F2 is inserted in the jet by being pulled by the yarn FT to which it is previously joined. The means for introducing the yarn F2 in the interlacing jet 19, in this case, consist of the yarn FT and the joining system of the yarns F2 and FT.

Feeding of composite yarn FC resumes downstream to the interlacing jet 19 after introduction of the yarn F2. When the composite yarn reaches the device 57, the latter starts winding the yarn on a new winding tube T; the yarn is cut and the suction of the yarn through the suction conduit mouth 66 ceases, as described in greater detail with reference to FIG. 7A-7C.

It is noted that the drawing shows a possible form of embodiment of the invention only and that numerous changes can be implemented without departing from the scope of the present invention. The presence of reference numerals in the annexed claims has the purpose of facilitating comprehension of the claims with reference to the above description and annexed drawings and does not limit the scope of protection represented by the claims.

The invention claimed is:

1. A method for producing a composite yarn and automatically replacing spools of elastic yarn, the method comprising:

providing a first spool of a first elastic yarn;

feeding said first elastic yarn to an interlacing jet, said interlacing jet covering said first elastic yarn with at least one covering yarn to form a composite yarn;

winding said composite yarn on a developing cop;

providing a second spool of a second elastic yarn;

interrupting composite yarn feeding to said developing cop and replacing the developing cop with a new tube when said first spool of elastic yarn is replaced with said second spool of elastic yarn;

inserting said second elastic yarn in said interlacing jet to resume forming said composite yarn, said covering yarn moving continuously, said second elastic yarn being joined to said continuously moving covering yarn;

starting winding composite yarn on said new tube, whereby said first spool of elastic yarn is automatically replaced with said second spool of elastic yarn when said first spool of elastic yarn is empty.

2. A method according to claim 1, wherein said first spool is arranged in a working position and the second spool is arranged in a standby position, said second spool being carried to said working position, said first spool being removed from said working position when the first spool must be replaced.

3. A method according to claim 1, wherein the initial free end of said second elastic yarn is held in a retaining member before inserting the second elastic yarn in said interlacing jet.

4. A method according to claim 1, wherein collecting at least the covering yarn fed via said interlacing jet during the time elapsing between the winding interruption of the developing cop and the start of winding of the composite yarn on said new tube.

5. A method according to claim 1, wherein said second elastic yarn is joined to the covering yarn in said interlacing jet.

6. A method according to claim 3, wherein the initial free end of the second elastic yarn is withheld by said retaining member downstream of the interlacing jet, with respect to the direction of feeding of the yarn through said interlacing jet.

7. A method according to claim 1, wherein said covering yarn is a multiple filament yarn.

8. A method according to claim 1, wherein said covering yarn is textured.

9. A method according to claim 8, wherein said covering yarn is fed along a feeding path from a feeding cop to said interlacing jet and textured along said feeding path.

10. A method according to claim 1, wherein the end of the first elastic yarn is detected, and stopping the feeding of the composite yarn to the developing cop and introducing the second elastic yarn in said interlacing jet upon detection of the end of the first elastic yarn.

11. A method according to claim 1, wherein said covering yarn, which is continuously fed, is collected by being sucked into a suction conduit between stopping feeding composite yarn to the developing cop and starting winding composite yarn on a new tube.

12. A method according to claim 1, wherein said first elastic yarn is stretched before being fed to said interlacing jet.

13. A method according to claim 12, wherein said covering yarn and said first elastic yarn are passed side by side in a stretching area upstream of the interlacing jet and fed from said stretching area to the interlacing jet along a common feeding path.

14. A method according to claim 13, wherein the first elastic yarn and the covering yarn are passed through a nip formed by two stretching rollers located in said stretching area.

15. A method according to claim 3, wherein:

the initial free end of the second elastic yarn is withheld by said retaining member downstream to the interlacing jet with respect to the feeding direction of the yarn through said interlacing jet;

a portion of the second elastic yarn is arranged alongside the first elastic yarn and the covering yarn between the stretching area and the interlacing jet; and the second elastic yarn is pushed into said stretching area by the side of the covering yarn when feeding of the second elastic yarn to said interlacing jet is started.

16. A method according to claim 1, wherein the spool from which the elastic yarn is fed to the interlacing jet is rotated around its axis to unwind the yarn.

17. A method according to claim 1, wherein the elastic yarn is unwound from the spool without rotating said spool around its axis.

18. A device for the production of a composite yarn, the device comprising:

an interlacing jet, said interlacing jet joining at least one covering yarn and at least one elastic yarn to form a composite yarn;

a defined feeding path of said covering yarn and a defined feeding path of said elastic yarn to said interlacing jet;

a spool supporting means for arranging at least a first spool of elastic yarn and at least a second spool of elastic yarn, winding members, said winding members winding the composite yarn on a developing cop;

an interrupting device, said interrupting device interrupting the feeding of composite yam to said developing cop, said interrupting device starting the winding of the composite yam on a new winding tube;

a retaining member arranged in an area of said interlacing jet, said retaining member holding an initial free end of said elastic yam of said second spool when said elastic yam from said first spool feeds said interlacing jet; and means for introducing said elastic yam of said second spool into said interlacing jet.

19. A device according to claim 18, wherein a collection member for collecting the covering yam which is fed substantially continuously while the complete cop of composite yam is replaced with a new winding tube.

20. A device according to claim 19, wherein said collection member is associated with said interrupting device.

21. A device according to claim 18, wherein said spool supporting means supports said first spool in a working position and said second spool in a standby position, said spool supporting means transferring said second spool from said standby position to said working position when said first spool must replaced.

22. A device according to claim 21, wherein said spool supporting means are provided with a translating movement from said standby position to said working position.

23. A device according to claim 18, wherein at least one texturing station is arranged along the feeding path of the covering yarn.

24. A device according to claim 18, wherein said retaining member of the initial free end of the elastic yarn of said second spool is combined with an introducing means for inserting said elastic yarn in the interlacing jet.

25. A device according to claim 18, wherein movement of said retaining member inserts said elastic yarn into said interlacing jet.

26. A device according to claim 23, wherein said retaining member is arranged downstream of said interlacing jet with respect to the feeding direction of the yarn.

27. A device according to claim 18, further comprising a sensor for generating a signal for starting the replacement procedure of the first spool of elastic yarn and replacing it with a second spool of elastic yarn.

28. A device according to claim 27, wherein said sensor detects the end of the elastic yarn of said first spool.

29. A device according to claim 18, wherein said collecting member of the covering yarn comprises a suction member.

30. A device according to claim 18, further comprising a stretching unit crossed by said covering yarn and by said elastic yarn, upstream to said interlacing jet.

31. A device according to claim 30, wherein said stretching unit comprises a pair of stretching rollers forming a nip crossed by said covering yarn and the elastic yarn from said first spool.

32. A device according to claim 30, wherein an inserting element the elastic yarn of said second spool inside said stretching unit.

33. A device according to claim 18, wherein said interlacing jet comprises a cover, said cover being opened to insert the elastic yarn from said second spool.

34. A device according to claim 18, wherein a member for joining the head of an elastic yarn to the covering yarn is arranged upstream of said interlacing jet.

35. A device according to claim 34, wherein said joining member consists of an auxiliary interlacing jet.

36. A device according to claim 30, wherein an oven crossed by said covering yarn is arranged along the path of said covering yarn, upstream of said stretching unit, said oven stabilizing the yarn.

37. A device according to claim 18, wherein an unwinding means rotates the spool from which the elastic yarn is fed to said interlacing jet.

38. A device according to claim 37, wherein said unwinding means is an unwinding roller in contact with the outer surface of the spool being unwound.

* * * * *